US006342007B1

(12) United States Patent
Wood et al.

(10) Patent No.: US 6,342,007 B1
(45) Date of Patent: Jan. 29, 2002

(54) FLUSH POKER GAME

(76) Inventors: Michael W. Wood; Terry L. Wilson, both of 11831 Wentling Ave., Suite #C, Baton Rouge, LA (US) 70816

( * ) Notice: Subject to any disclaimer, the term of this patent is extended or adjusted under 35 U.S.C. 154(b) by 0 days.

(21) Appl. No.: 09/028,189

(22) Filed: Feb. 23, 1998

(51) Int. Cl.[7] ..... A63F 9/24

(52) U.S. Cl. ..... 463/13; 463/11; 463/13; 463/20; 463/21; 273/292

(58) Field of Search ..... 463/11, 13, 16, 463/20, 21; 273/269, 303, 292

(56) References Cited

U.S. PATENT DOCUMENTS

| | | | | |
|---|---|---|---|---|
| 5,019,973 A | | 5/1991 | Wilcox et al. | 364/412 |
| 5,332,228 A | * | 7/1994 | Schultz | 273/292 |
| 6,237,916 B1 | * | 5/2001 | Webb | 273/292 |
| 6,299,532 B1 | * | 10/2001 | Smith | 463/13 |

* cited by examiner

*Primary Examiner*—Michael O'Neill
*Assistant Examiner*—Corbett B Coburn

(57) ABSTRACT

The player is dealt an initial hand of five cards, all face up. If four of these first five cards are of the same suit, the player is offered the opportunity to proceed to a second video screen in which the remaining nine cards of that suit are displayed to the player. One of these nine cards is randomly selected and added to the player's initial five card hand. The player is assured of achieving at least a Flush with the possibility of improving his hand to a Straight Flush or a Royal Flush depending on the first four cards and the fifth card selected. After this random selection of the fifth card, the player's hand is evaluated to determine what poker hand ranking the player has achieved and the player is paid an award based on the amount wagered by the player in accordance with a pay table. If the player does not receive four cards to a flush on the initial deal or if the player declines to take the fifth flush card, the game continues in the conventional manner of video poker with the player discarding unwanted cards and receiving replacement cards for the discarded hand. The final five card hand is then compared to a pay table to determine whether the player has achieved a winning hand based on conventional poker hand rankings.

8 Claims, 3 Drawing Sheets

| DRAW POKER | NUMBER OF COINS BET | | | | |
|---|---|---|---|---|---|
| POKER HAND | 1 | 2 | 3 | 4 | 5 |
| ROYAL FLUSH | 250 | 500 | 750 | 1000 | 4000 |
| STRAIGHT FLUSH | 50 | 100 | 150 | 200 | 250 |
| FOUR-OF-A-KIND (ACES) | 40 | 80 | 120 | 160 | 200 |
| FOUR-OF-A-KIND (2'S,3'S AND 4'S) | 30 | 60 | 90 | 120 | 150 |
| FOUR-OF-A-KIND (5'S THRU KINGS) | 20 | 40 | 60 | 80 | 100 |
| FULL HOUSE | 4 | 8 | 12 | 16 | 20 |
| FLUSH | 4 | 8 | 12 | 16 | 20 |
| STRAIGHT | 4 | 8 | 12 | 16 | 20 |
| THREE-OF-A-KIND | 3 | 6 | 9 | 12 | 15 |
| TWO PAIR | 2 | 4 | 6 | 8 | 10 |
| JACKS OR BETTER | 1 | 2 | 3 | 4 | 5 |

| DRAW POKER | NUMBER OF COINS BET | | | | |
|---|---|---|---|---|---|
| POKER HAND | 1 | 2 | 3 | 4 | 5 |
| ROYAL FLUSH | 250 | 500 | 750 | 1000 | 4000 |
| STRAIGHT FLUSH | 50 | 100 | 150 | 200 | 250 |
| FOUR-OF-A-KIND (ACES) | 40 | 80 | 120 | 160 | 200 |
| FOUR-OF-A-KIND (2'S,3'S AND 4'S) | 30 | 60 | 90 | 120 | 150 |
| FOUR-OF-A-KIND (5'S THRU KINGS) | 20 | 40 | 60 | 80 | 100 |
| FULL HOUSE | 4 | 8 | 12 | 16 | 20 |
| FLUSH | 4 | 8 | 12 | 16 | 20 |
| STRAIGHT | 4 | 8 | 12 | 16 | 20 |
| THREE-OF-A-KIND | 3 | 6 | 9 | 12 | 15 |
| TWO PAIR | 2 | 4 | 6 | 8 | 10 |
| JACKS OR BETTER | 1 | 2 | 3 | 4 | 5 |

| DRAW POKER | NUMBER OF COINS BET | | | | |
|---|---|---|---|---|---|
| POKER HAND | 1 | 2 | 3 | 4 | 5 |
| ROYAL FLUSH | 250 | 500 | 750 | 1000 | 4000 |
| STRAIGHT FLUSH | 50 | 100 | 150 | 200 | 250 |
| FOUR-OF-A-KIND (ACES) | 40 | 80 | 120 | 160 | 200 |
| FOUR-OF-A-KIND (2'S,3'S AND 4'S) | 30 | 60 | 90 | 120 | 150 |
| FOUR-OF-A-KIND (5'S THRU KINGS) | 20 | 40 | 60 | 80 | 100 |
| FULL HOUSE | 4 | 8 | 12 | 16 | 20 |
| FLUSH | 4 | 8 | 12 | 16 | 20 |
| STRAIGHT | 4 | 8 | 12 | 16 | 20 |
| THREE-OF-A-KIND | 3 | 6 | 9 | 12 | 15 |
| TWO PAIR | 2 | 4 | 6 | 8 | 10 |
| JACKS OR BETTER | 1 | 2 | 3 | 4 | 5 |

FLUSH POKER GAME

This invention relates to a poker game that has a special second game within a game event occurring when the player achieves a four card flush on the deal, and more particularly to a poker game played on an electronic video gaming machine in which the player who is initially dealt a four card flush automatically is assured of receiving a five card flush as his final hand.

BACKGROUND OF THE INVENTION

There has been many types of video poker machines developed over the last twenty years. The first electronic video poker machine displayed the basic game of draw poker. The game was a single player game, i.e. the player plays only his own hand and does not have to beat the hand of another player or the dealer. A single hand of five cards from a single standard deck of fifty-two play cards was dealt to the player and displayed on the video screen. The player selected which cards to hold, and the unheld cards were discarded and replaced with new cards from the same original deck. The resulting hand was the final hand and the player won or lost based on the poker hand ranking of the final hand. The poker hand ranking of the final hand was compared to a pay table and winning hands were paid based on the number of coins wagered by the player.

In typical draw poker gaming machines, the conventional poker hand rankings that are winning combinations are a Royal Flush, a Straight Flush, a Four of a Kind, a Full House, a Flush, a Straight, a Three of a Kind, a Two Pair and a Pair of Jacks or Better. The pay table is established based on the mathematical probability of achieving one of these poker hand rankings and the payout to the player is based on the number of coins, tokens or credits wagered by the player.

The original draw poker gaming machine has been modified to use jokers as wild cards or to use deuces (or even other cards) as wild cards. "Joker's Wild" and "Deuces Wild" draw poker also display to the player a single five card hand and allow the player to discard unwanted cards and receive replacement cards. The pay table is modified to recognize the differing odds for achieving various poker hands when wild cards are involved. Furthermore, different poker hand rankings are used in the pay table to recognize different winning combinations that can be achieved using wild cards, such as Five of a Kind and Royal Flushes with wild cards.

In conventional video draw poker, a typical pay schedule would be as shown in Table 1:

TABLE 1

| DRAW POKER | NUMBER OF COINS BET | | | | |
|---|---|---|---|---|---|
| POKER HAND | 1 | 2 | 3 | 4 | 5 |
| ROYAL FLUSH | 250 | 500 | 750 | 1000 | 4000 |
| STRAIGHT FLUSH | 50 | 100 | 150 | 200 | 250 |
| FOUR-OF-A-KIND | 25 | 50 | 75 | 100 | 125 |
| FULL HOUSE | 9 | 18 | 27 | 36 | 45 |
| FLUSH | 6 | 12 | 18 | 24 | 30 |
| STRAIGHT | 4 | 8 | 12 | 16 | 20 |
| THREE-OF-A-KIND | 3 | 6 | 9 | 12 | 15 |
| TWO PAIR | 2 | 4 | 6 | 8 | 10 |
| JACKS OR BETTER | 1 | 2 | 3 | 4 | 5 |

Many different types of pay tables have been developed. Pay tables with large payouts for higher ranking poker hands have been used, but normally the money for these large payouts has been provided by lowering the payouts for the lower ranking poker hands.

Because of the proliferation of gaming throughout the United States and foreign countries, there is a need for other types of gaming machines to be developed to meet the demand. New forms of video poker machines are needed to provide variety to the players and maintain their interest. Many players have become bored and disenchanted with conventional video Draw Poker and are looking for other forms of gaming entertainment.

It is an object of the present invention to provide a new, exciting and challenging variation of conventional electronic video poker that will stimulate player interest.

It is a further object of the present invention to provide a variation to conventional electronic video poker in which, whenever the player is dealt a four card flush on his first five cards, the player automatically is assured of achieving at least a five card flush since the player will be receiving a fifth card of that suit.

It is a feature of the present invention that if the player has four to a flush on the initial deal, the player is offered the opportunity to go to a second screen display in which the remaining nine cards of the same suit are displayed to the player. One of these nine cards are randomly selected and added to the player's initial hand to provide the player with a five card flush.

It is an advantage of the present invention that the player is always provided with the opportunity to achieve a five card flush whenever the player is dealt a four card flush on the initial five card deal.

Other objects, features and advantages of the present invention will become apparent from a consideration of the following detailed description.

SUMMARY OF THE INVENTION

The present invention is based in general on a modification of conventional electronic video poker. The player is dealt an initial hand of five cards, all face up. If four of these first five cards are of the same suit, the player is offered the opportunity to proceed to a second video screen in which the remaining nine cards of that suit are displayed to the player. One of these nine cards is randomly selected and added to the player's initial five card hand. The player is assured of achieving at least a Flush with the possibility of improving his hand to a Straight Flush or a Royal Flush depending on the first four card flush initially dealt to the player and the fifth card selected.

After this random selection of the fifth card, the player's hand is evaluated to determine what poker hand ranking the player has achieved and the player is paid an award based on the amount wagered by the player in accordance with a pay table.

If the player does not receive four cards to a flush on the initial deal or if the player declines to take the fifth flush card, the game continues in the conventional manner of video poker with the player discarding unwanted cards and receiving replacement cards for the discarded hand. The final five card hand is then compared to a pay table to determine whether the player has achieved a winning hand based on conventional poker hand rankings.

DETAILED DESCRIPTION OF THE PREFERRED EMBODIMENTS

The present invention is based on the general format of conventional electronic video poker in which a computer program operates the gaming machine and causes a deck of cards to be shuffled and then randomly displayed on the video screen display of an electronic gaming machine. In the basic form of conventional video poker, initially five cards are displayed all face up from a single fifty-two card deck. By manipulating "Hold" buttons, the player selects which cards to hold. When the player presses the "Draw" button, the unwanted cards are removed from the video screen display and replacement cards are dealt and displayed to the player on the video screen display from the same fifty-two card deck used in the initial deal. This results in a final five card hand. This final five card hand is compared to a pay table which uses conventional poker hand rankings as the winning card combinations. If the player has a winning hand he receives an award based on the number of coins, tokens or credits wagered by the player.

In the present invention, the player is also dealt an initial hand of five cards which are displayed all face up on the video screen display. In the preferred embodiment of the present invention, the initial five cards are dealt from a pool of cards comprising a standard fifty-two card deck. However, alternatively, one or more Jokers can be added to the fifty-two card deck with the Jokers being used as wild cards during the play of the game.

If the player receives four cards of the same suit (a four card flush) on the initial deal of the five cards from the pool of cards, the player is offered the opportunity to automatically receive a fifth card from the same suit. If the player agrees to select this option, the player is taken to a second screen display which shows the remaining nine cards of the same suit as the suit of the initial four card flush. One of these nine cards are randomly selected and added to the player's initial hand as a replacement card for the fifth card that was not part of the four card flush. This becomes the player's final five card hand and the player is paid a winning amount based on the pay table.

Figure 1:
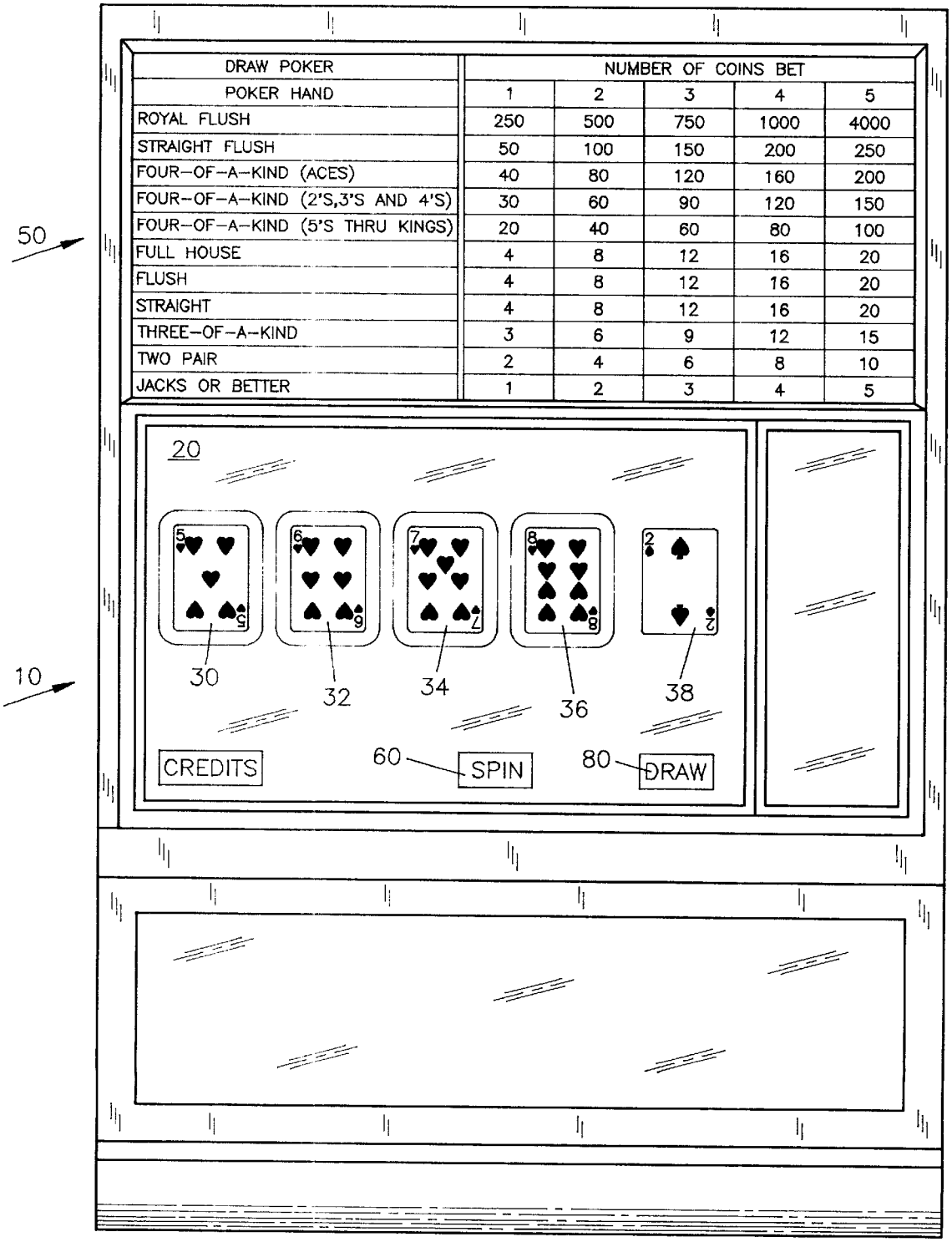
FIG. 1 shows a video screen display and pay table used in the method of the present invention.

FIG. 1 shows an electronic video gaming machine 10 that is programmed to display the method of the present invention. The electronic video gaming machine has a video display screen 20 that shows the cards during the play of the hand. In a typical configuration, the pay table 50 is shown above the video display screen 20, although the pay table 50 can also be shown on a portion of the video display screen 20 if desired.

FIG. 1 shows a representative video screen display of an initial five card deal in which the player has been dealt a four card flush. The player has received the 5♥ 30, the 6♥ 32, the 7♥ 34, the 8♥ 36, and the 24♠ 38. On this initial deal, the player will be offered the opportunity to discard the 24♠ for another Heart. The player is offered this opportunity because the player has been dealt a four card flush on the initial deal of the first five cards.

When this four card flush situation occurs, the player is alerted to this situation in any suitable manner by the electronics of the gaming machine. In the preferred embodiment of the present invention, the electronic gaming machine is programmed to visually display to the player in a highlighted manner the four cards that make up the four card flush. In one version of displaying the possible four card flush situation, the graphics could simply highlight in bold or flash the four cards that comprise the four card flush. Any suitable display mechanism can be used.

When the player is alerted that a four card flush situation is present, the player selects whether or not to take automatically the fifth card which will complete the flush as a five card flush. In the preferred embodiment of the present invention, a "SPIN" button can be provided on the button panel of the gaming machine and the player can press the "SPIN" button to effect the selection of a fifth card from the same suit as the suit of the four card flush. Alternatively, if touch screen technology is being employed, a touch screen "SPIN" panel 60 can be provided for the player to make this selection as shown in FIG. 1.

Figure 2:
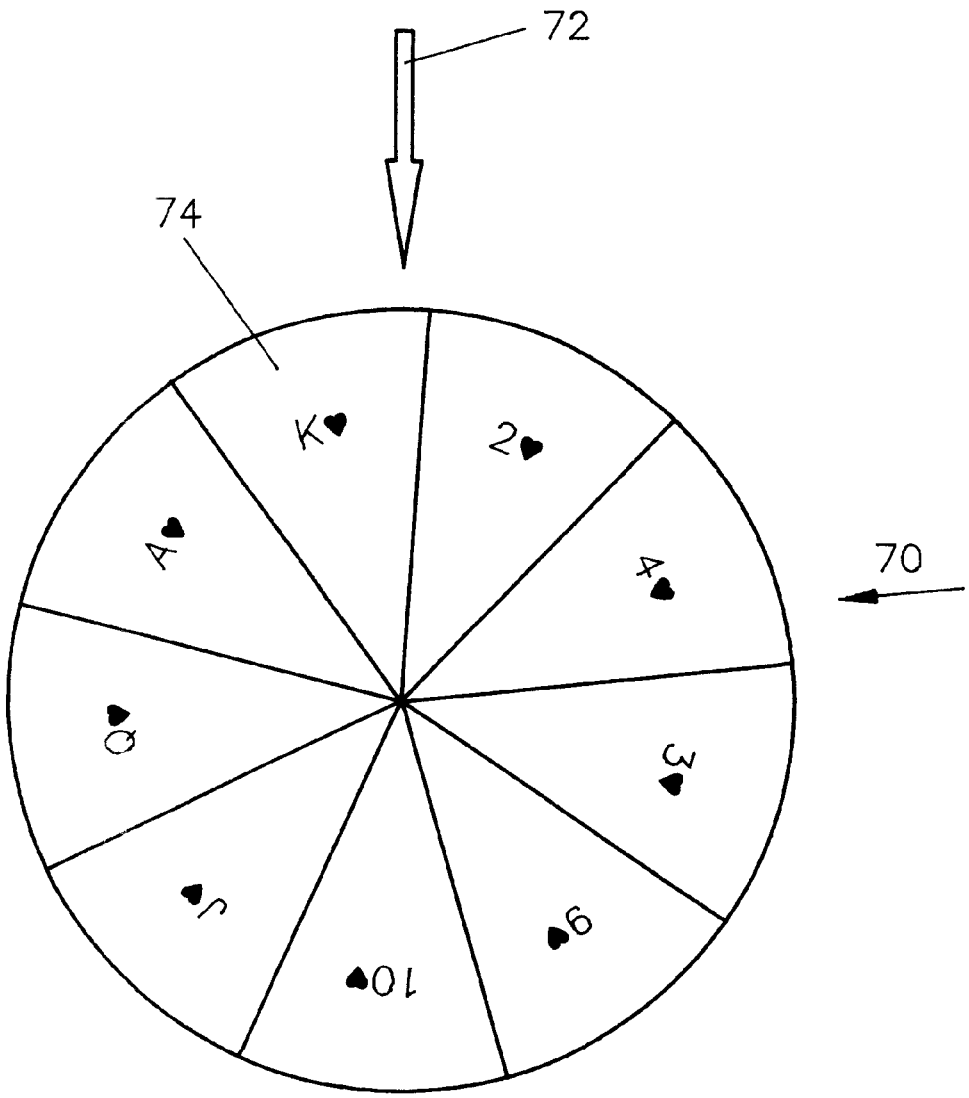
FIG. 2 shows a video screen display of the second screen in which the random selection of the fifth card is made.

If the player selects to take this option, the screen display shown in FIG. 1 is replaced by a new screen display shown in FIG. 2.

This second screen display is used to show the random selection of the fifth card to complete the player's five card flush. There is nothing critical about how this random display is shown to the player, but in the preferred embodiment, a wheel 70 is displayed that is rotating about a central axis. The wheel is divided into nine segments, each containing representations of the nine remaining cards from the suit of the player's four card flush. As the wheel rotates, each of the segments pass under an indicator 72, such as an arrow. The wheel rotates for a predetermined length of time, for example one or two seconds, and then the wheel comes to rest with one of the segments positioned under the indicator 72. The stopping location of the wheel is determined randomly in any conventional manner, such as by the use of a random number generator which selects randomly one of the nine possible stopping locations of the wheel. The card represented in this segment that has stopped under the indicator 72 becomes the card that will be added to the player's hand to complete the five card flush.

Figure 3:
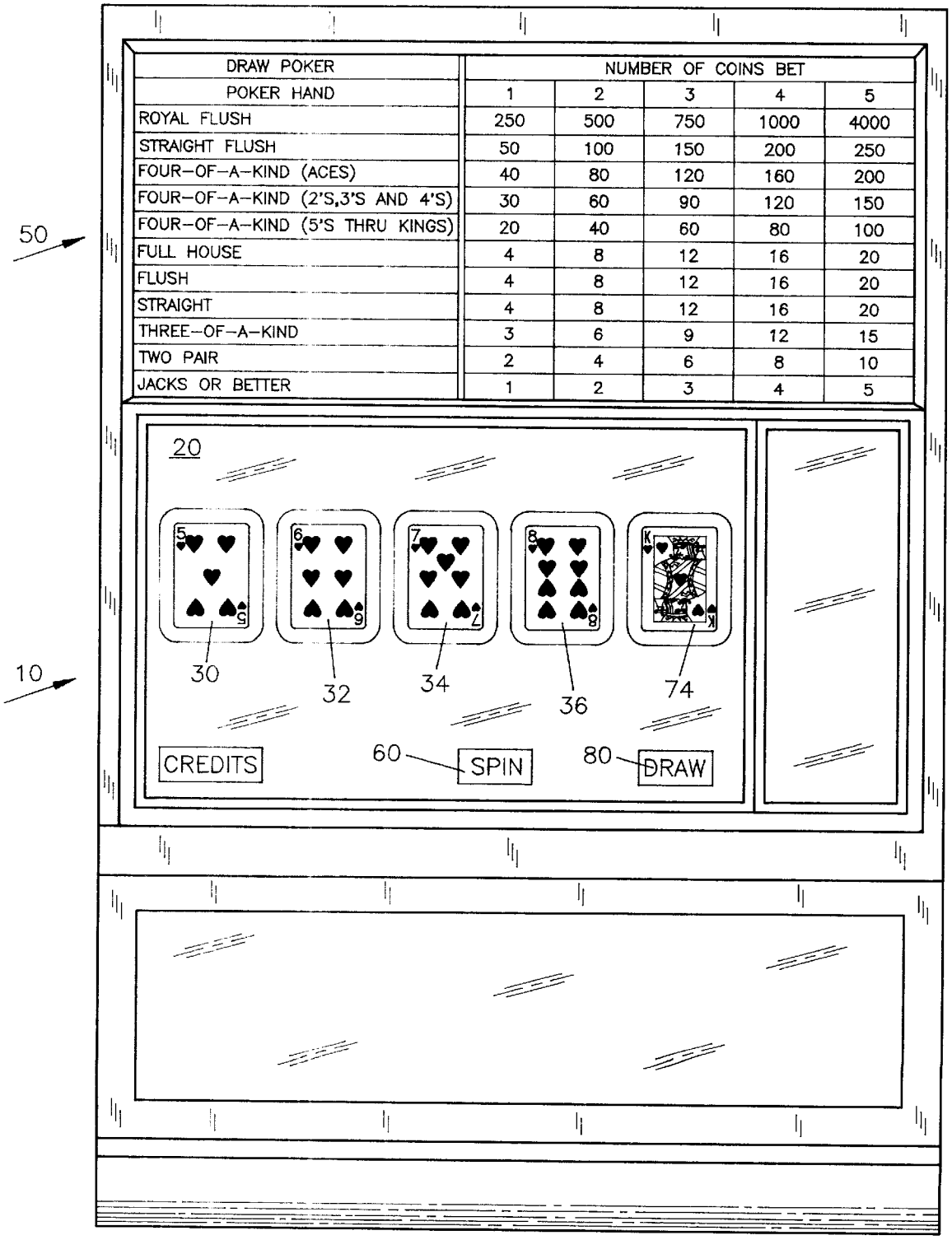
FIG. 3 shows a video screen and pay table after the replacement fifth card is selected.

As shown in FIG. 2, the wheel has stopped rotating on the K♥ 74 which is added to the player's hand as shown in FIG. 3. In this example, the player has achieved a simple Flush and is paid according to the number of coins, tokens or credits wagered based on the pay table for a Flush. For example, if the player had wagered five credits, the player would receive 20 credits for achieving a simple Flush as shown in pay table 50.

It is apparent that this method of play increases the player's chances of obtaining Flushes, Straight Flushes and Royal Flushes. Whenever the player is dealt four to a flush, the player automatically can achieve a Flush. If the player is missing one card to a Straight Flush, the player has no higher odds than one chance in nine to complete the Straight Flush, which are much lower odds than would be present if all of the remaining forty-seven cards from a standard deck of playing cards were available as the pool from which the replacement card was selected. Likewise, if the first cards dealt to the player comprised four to a Royal Flush, the player again has a much better opportunity to draw the missing fifth card to complete the Royal Flush than the player would have if all of the remaining forty-seven cards from a standard deck of playing cards were available as the pool from which the replacement card was selected.

In one preferred embodiment of the present invention, any of the four suits are active for possible four card flush situations. In other words, if the player receives four to a flush in the first five cards of any of Spades, Hearts, Diamonds or Clubs, the player is offered the opportunity to go to the second screen and spin for is the fifth card of the appropriate suit.

Table 2 shows a typical pay table that can be used with the method of the present invention when all four suits are active for possible four card flush situations.

TABLE 2

| DRAW POKER | NUMBER OF COINS BET | | | | |
|---|---|---|---|---|---|
| POKER HAND | 1 | 2 | 3 | 4 | 5 |
| ROYAL FLUSH | 250 | 500 | 750 | 1000 | 4000 |
| STRAIGHT FLUSH | 50 | 100 | 150 | 200 | 250 |
| FOUR-OF-A-KIND (ACES) | 40 | 80 | 120 | 160 | 200 |
| FOUR-OF-A-KIND (2'S, 3'S AND 4'S) | 30 | 60 | 90 | 120 | 150 |
| FOUR-OF-A-KIND (5'S THRU KINGS) | 20 | 40 | 60 | 80 | 100 |
| FULL HOUSE | 4 | 8 | 12 | 16 | 20 |
| FLUSH | 4 | 8 | 12 | 16 | 20 |
| STRAIGHT | 4 | 8 | 12 | 16 | 20 |
| THREE-OF-A-KIND | 3 | 6 | 9 | 12 | 15 |
| TWO PAIR | 1 | 2 | 3 | 4 | 5 |
| JACKS OR BETTER | 1 | 2 | 3 | 4 | 5 |

The pay table shown in Table 2 is based on a Double Bonus Poker pay table modified to reflect that Flushes will occur more often. Any suitable pay table can be used with the method of the present invention based on the hold percentage desired to be employed by the operator of the gaming machine.

In another embodiment of the present invention, the player can select which of the four suits the player wishes to have active as possible four card flush situations. Depending on the number of suits selected by the player, the pay table can be changed.

For example, if the player selects three of the four suits as active suits for possible four card flush situations, the pay table shown in Table 3 can be used.

TABLE 3

| DRAW POKER | NUMBER OF COINS BET | | | | |
|---|---|---|---|---|---|
| POKER HAND | 1 | 2 | 3 | 4 | 5 |
| ROYAL FLUSH | 250 | 500 | 750 | 1000 | 4000 |
| STRAIGHT FLUSH | 50 | 100 | 150 | 200 | 250 |
| FOUR-OF-A-KIND (ACES) | 60 | 120 | 180 | 240 | 300 |
| FOUR-OF-A-KIND (2'S, 3'S AND 4'S) | 40 | 80 | 120 | 160 | 200 |
| FOUR-OF-A-KIND (5'S THRU KINGS) | 20 | 40 | 60 | 80 | 100 |
| FULL HOUSE | 6 | 12 | 18 | 24 | 30 |
| FLUSH | 5 | 10 | 15 | 20 | 25 |
| STRAIGHT | 4 | 8 | 12 | 16 | 20 |
| THREE-OF-A-KIND | 3 | 6 | 9 | 12 | 15 |
| TWO PAIR | 1 | 2 | 3 | 4 | 5 |
| JACKS OR BETTER | 1 | 2 | 3 | 4 | 5 |

This three active suit pay table shown in Table 3 is based on a Double Bonus Poker pay table modified to reflect that Flushes will occur more often. Any suitable pay table can be used with the method of the present invention based on the hold percentage desired to be employed by the operator of the gaming machine.

If the player selects two of the four suits as active suits for possible four card flush situations, the pay table shown in Table 4 can be used.

TABLE 4

| DRAW POKER | NUMBER OF COINS BET | | | | |
|---|---|---|---|---|---|
| POKER HAND | 1 | 2 | 3 | 4 | 5 |
| ROYAL FLUSH | 250 | 500 | 750 | 1000 | 4000 |
| STRAIGHT FLUSH | 50 | 100 | 150 | 200 | 250 |
| FOUR-OF-A-KIND (ACES) | 120 | 240 | 360 | 480 | 600 |
| FOUR-OF-A-KIND (2'S, 3'S AND 4'S) | 40 | 80 | 120 | 160 | 200 |
| FOUR-OF-A-KIND (5'S THRU KINGS) | 20 | 40 | 60 | 80 | 100 |
| FULL HOUSE | 8 | 16 | 24 | 32 | 40 |
| FLUSH | 5 | 10 | 15 | 20 | 25 |
| STRAIGHT | 4 | 8 | 12 | 16 | 20 |
| THREE-OF-A-KIND | 3 | 6 | 9 | 12 | 15 |
| TWO PAIR | 1 | 2 | 3 | 4 | 5 |
| JACKS OR BETTER | 1 | 2 | 3 | 4 | 5 |

This two active suit pay table shown in Table 4 is based on a Double Bonus Poker pay table modified to reflect that Flushes will occur more often. Any suitable pay table can be used with the method of the present invention based on the hold percentage desired to be employed by the operator of the gaming machine.

If the player selects one of the four suits as the only active suit for possible four card flush situations, the pay table shown in Table 5 can be used.

TABLE 5

| DRAW POKER | NUMBER OF COINS BET | | | | |
|---|---|---|---|---|---|
| POKER HAND | 1 | 2 | 3 | 4 | 5 |
| ROYAL FLUSH | 250 | 500 | 750 | 1000 | 4000 |
| STRAIGHT FLUSH | 50 | 100 | 150 | 200 | 250 |
| FOUR-OF-A-KIND (ACES) | 120 | 240 | 360 | 480 | 600 |
| FOUR-OF-A-KIND (2'S, 3'S AND 4'S) | 40 | 80 | 120 | 160 | 200 |
| FOUR-OF-A-KIND (5'S THRU KINGS) | 20 | 40 | 60 | 80 | 100 |
| FULL HOUSE | 8 | 16 | 24 | 32 | 40 |
| FLUSH | 5 | 10 | 15 | 20 | 25 |
| STRAIGHT | 4 | 8 | 12 | 16 | 20 |
| THREE-OF-A-KIND | 3 | 6 | 9 | 12 | 15 |
| TWO PAIR | 1 | 2 | 3 | 4 | 5 |
| JACKS OR BETTER | 1 | 2 | 3 | 4 | 5 |

This one active suit pay table shown in Table 5 is based on a Double Bonus Poker pay table modified to reflect that Flushes will occur more often. Any suitable pay table can be used with the method of the present invention based on the hold percentage desired to be employed by the operator of the gaming machine.

If the player does not receive four cards to a flush on the initial deal or if the player declines to take the fifth flush card, the game continues in the conventional manner of video poker with the player discarding unwanted cards and receiving replacement cards for the discarded hand. The final five card hand is then compared to a pay table to determine whether the player has achieved a winning hand based on conventional poker hand rankings.

In the preferred embodiment of the present invention, the player is offered the chance to take the opportunity to receive an automatic five card flush whenever the player is dealt a four card flush in his first five cards. It is not mandatory that the player receive the fifth card to complete the flush. The player may decide that his hand should be played without taking this opportunity. For example, the player may initially be dealt a four card flush that includes an Ace and a second Ace from another suit. Since in the pay tables shown above, Four Aces is quite a large payoff, the player may choose to hold the pair of Aces instead of taking the guaranteed payout for a Flush. Or the player may be dealt the Ace♥, the King♥, the Queen♥, the 3♥ and the 2♠. Rather than take a simple Flush, the player may decide to hold the Ace♥, the King♥ and the Queen♥ and try to draw a Royal Flush.

In both of these situations, the player simply declines the "Spin" option, holds the cards he wants to keep and presses the "Draw" location 80 (or the "Draw" button on the button panel) and two replacement cards are dealt to the player from the remaining forty-seven cards of the deck of cards.

One of the attractive features of electronic video poker is the control the player has over the holding and discarding of cards. Many gaming jurisdictions consider electronic video poker to be a game of skill. By allowing the player to decide whether to proceed to the second screen and spin the wheel 70 when he is eligible to do so, this decision required by the player contributes to the skill aspect of the method of play.

Alternatively, the five card flush may be mandatory and the player will not have a choice whether to proceed to the second screen and spin the wheel 70. In such a situation, the computer controls of the gaming machine 10 automatically effects the display of the second screen, automatically spins the wheel 70 and randomly provides the player with the fifth card to compete the five card flush.

The method of the present invention can also be applied to any of the conventional electronic video poker variations using Jokers or wild cards. The pay table need only be adjusted to the reflect the probability of achieving the various winning hand combinations that are possible when the swap feature is employed in conjunction with the video poker variation being used.

There are other modifications that can be made to the present invention. For example, the method of play of the present invention can also be applied to the situation in which the player is dealt a five card flush in the initial deal of five cards. If the player is dealt a five card flush, the player can be given the opportunity to discard one of the initial five cards and proceed to the second screen in which a replacement fifth card from the same suit as the suit of the five card flush will be randomly selected for the player in any suitable manner, such as by spinning the wheel as described above. In this variation, the spinning wheel would only have eight locations since there would only be eight remaining cards from the suit of the initial five card flush. If the player was dealt a five card flush in which four of the cards were four-fifths of a Royal Flush or four-fifths of a Straight Flush, the player would have the opportunity in this variation of achieving either the Royal Flush or the Straight Flush without risk of losing the simple Flush since the replacement fifth card would always be from the same suit as the initial five card flush.

Another variation of the present invention involves applying the method of the present invention to those situations in which the player is dealt a four card straight on the first five cards. In this situation, the player is provided with the opportunity of discarding the fifth card that does not go with the four card straight and proceeding to a second screen in which a replacement fifth card would be randomly selected from those cards that would complete the five card straight. The replacement fifth card would be randomly selected for the player in any suitable manner, such as by spinning the wheel as described above. In the situation in which the player has a four card straight with the missing card requiring a draw to an inside straight, the random selection would be from a group of only four cards. In the situation in which the player has a four card straight with the missing card requiring a draw to an outside straight, the random selection would be from a group of eight cards. Suitable pay tables would be designed to reflect the probabilities that straights would occur more often than they do in conventional video draw poker.

All of the variations of the present invention have been described in connection with electronic video poker gaming machines, however the method of the present invention can also be practiced in a live gaming table format.

While the invention has been illustrated with respect to several specific embodiments thereof, these embodiments should be considered as illustrative rather than limiting. Various modifications and additions may be made and will be apparent to those skilled in the art. Accordingly, the invention should not be limited by the foregoing description, but rather should be defined only by the following claims.

What is claimed is:

1. A method of playing a poker game comprising:

a) dealing a player an initial five card hand from a pool of playing cards;

b) if the initial five card hand includes four cards of the same suit and a fifth card of a different suit, offering the player the opportunity to obtain a replacement card of the same suit to form a five card flush;

c) if the player accepts the offer, randomly selecting a fifth card of the same suit as the suit of the first four cards;

d) replacing the fifth card with the replacement card;

e) determining a value for the player's selected hand based on poker hand ranking; and f) awarding the player a predetermined amount based on the value of the player's selected hand.

2. The method of claim 1 further including the steps of:

a) the player making a wager to participate in the play of the game; and b) the predetermined amount awarded to the player being based on the amount of the wager.

3. The method of claim 1 in which the value of the player's selected hand is determined by comparing the poker hand ranking of the player's final hand to a pay table.

4. The method of claim 3 in which the pay table comprises:

| DRAW POKER | NUMBER OF COINS BET | | | | |
|---|---|---|---|---|---|
| POKER HAND | 1 | 2 | 3 | 4 | 5 |
| ROYAL FLUSH | 250 | 500 | 750 | 1000 | 4000 |
| STRAIGHT FLUSH | 50 | 100 | 150 | 200 | 250 |
| FOUR-OF-A-KIND (ACES) | 80 | 160 | 240 | 320 | 400 |
| FOUR-OF-A-KIND (2'S, 3'S AND 4'S) | 40 | 80 | 120 | 160 | 200 |
| FOUR-OF-A-KIND (5'S THRU KINGS) | 20 | 40 | 60 | 80 | 100 |
| FULL HOUSE | 5 | 10 | 15 | 20 | 25 |
| FLUSH | 8 | 16 | 24 | 32 | 40 |
| STRAIGHT | 4 | 8 | 12 | 16 | 20 |
| THREE-OF-A-KIND | 3 | 6 | 9 | 12 | 15 |
| TWO PAIR | 1 | 2 | 3 | 4 | 5 |
| JACKS OR BETTER | 1 | 2 | 3 | 4 | 5 |

5. A method of playing a poker game comprising:

a) dealing a player an initial five card hand from a pool of playing cards;

b) if the initial five card hand includes four cards of the same suit and a fifth card of a different suit, randomly selecting a fifth card of the same suit as the suit of the first four cards;

c) replacing the fifth card with the replacement card;

d) determining a value for the player's selected hand based on poker hand ranking; and e) awarding the player a predetermined amount based on the value of the player's selected hand.

6. The method of claim 5 further including the steps of:

a) the player making a wager to participate in the play of the game; and b) the predetermined amount awarded to the player being based on the amount of the wager.

7. The method of claim 5 in which the value of the player's selected hand is determined by comparing the poker hand ranking of the player's final hand to a pay table.

8. The method of claim 7 in which the pay table comprises:

| DRAW POKER | NUMBER OF COINS BET | | | | |
|---|---|---|---|---|---|
| POKER HAND | 1 | 2 | 3 | 4 | 5 |
| ROYAL FLUSH | 250 | 500 | 750 | 1000 | 4000 |
| STRAIGHT FLUSH | 50 | 100 | 150 | 200 | 250 |
| FOUR-OF-A-KIND (ACES) | 80 | 160 | 240 | 320 | 400 |
| FOUR-OF-A-KIND (2'S, 3'S AND 4'S) | 40 | 80 | 120 | 160 | 200 |
| FOUR-OF-A-KIND (5'S THRU KINGS) | 20 | 40 | 60 | 80 | 100 |
| FULL HOUSE | 5 | 10 | 15 | 20 | 25 |
| FLUSH | 8 | 16 | 24 | 32 | 40 |
| STRAIGHT | 4 | 8 | 12 | 16 | 20 |
| THREE-OF-A-KIND | 3 | 6 | 9 | 12 | 15 |
| TWO PAIR | 1 | 2 | 3 | 4 | 5 |
| JACKS OR BETTER | 1 | 2 | 3 | 4 | 5 |

* * * * *